United States Patent [19]

Lian

[11] 3,935,399

[45] Jan. 27, 1976

[54] LOUD SPEAKERS

[76] Inventor: Ragnar Lian, Cortinavej 27, 8363 Stilling, Denmark

[22] Filed: Dec. 12, 1973

[21] Appl. No.: 423,896

[30] Foreign Application Priority Data

Dec. 27, 1972 Denmark ..... 6465/72

[52] U.S. Cl. ..... 179/115.5 VC

[51] Int. Cl.[2] ..... H04R 9/00

[58] Field of Search ..... 179/115.5 R, 115.5 PC, 179/115.5 VC, 120

[56] References Cited

FOREIGN PATENTS OR APPLICATIONS 824,433 7/1937 Italy ..... 179/115.5 VC

*Primary Examiner*—Ralph D. Blakeslee

*Attorney, Agent, or Firm*—Craig & Antonelli

[57] ABSTRACT

A loud speaker of the oscillating coil type including a voice coil associated with a loud speaker membrane and a magnetic circuit having an annular air gap in which the coil is located in such a manner that in its neutral, non-energized condition the coil projects axially from the air gap substantially uniformly to both sides thereof so as to be able to oscillate substantially symmetrically about the middle plane of the air gap, a cylindric element of an electrically conducting material being rigidly associated with the magnetic circuit concentrically with the coil and extending into the air gap from one side thereof, characterised in that the cylindric element is extended so as to additionally project outwardly from the air gap to the other side thereof. It is obtained hereby that the voice coil is inductively short circuited in all working positions thereof, whereby it responds rapidly to changes of the input voltage and thus causes the sound to be reproduced with a minimum of distortion.

7 Claims, 2 Drawing Figures

LOUD SPEAKERS

Figure 2:
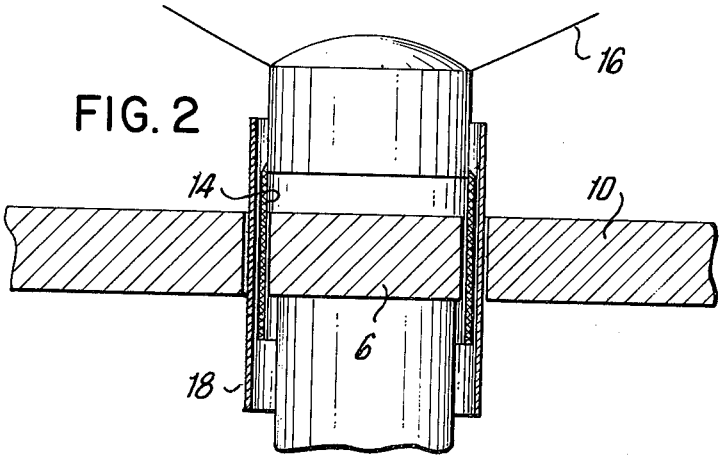

The present invention relates to a loud speaker of the oscillating coil type including a voice coil associated with a loud speaker membrane and a magnetic circuit having an annular air gap in which the coil is located in such a manner that in its neutral, non-energized condition the coil projects axially from the air gap substantially uniformly to both sides thereof so as to be able to oscillate substantially symmetrically about the middle plane of the air gap, a cylindric element of an electrically conducting material being rigidly associated with the magnetic circuit concentrically with the coil and extending into the air gap from one side thereof.

In modern loud speakers the magnetic circuit normally comprises a flat iron disc at the middle of which there is mounted a projecting rod magnet, the outer end of which carries a disc-shaped pole piece of slightly larger diameter than that of the rod magnet. At the periphery of the base iron disc there is mounted an iron cylinder projecting concentrically with the rod magnet and carrying it at its outer end an annular iron disc situated in level with the pole shoe whereby the annular air gap is defined between the outer periphery of the inner pole piece and the periphery of the central opening of the annular iron disc. Thus, in the air gap there will exist a radial magnetic field in which the voice coil is present, whereby the coil will reciprocate in the gap according to the oscillations of a tone frequent signal current fed to the coil, and a corresponding sound will be produced by the loud speaker membrane.

The rod magnets normally used are made of a material from the surface of which material slivers may crack off from time to time and since the tolerance between the coil and the gap defining pole surfaces should be very small, the occurrence of such slivers in the air gap may highly disturb the operation of the loud speaker. It is a usual measure, therefore, to encapsulate the magnet or both the magnet and its associated pole disc in a thin-walled cylinder, whereby the loose slivers are maintained within the cylinder and prevented from getting access to the air gap.

It is already known that the use of such a shield cylinder involves an electro-acoustic advantage if the cylinder is made of an electrically conducting material, viz, as follows:

As known, due to self-induction, when a voltage applied to a coil increases or decreases electromotive forces will be induced which tend to counteract the change of the electric state of the coil, i.e. a momentary increase of the voltage will not give rise to a correspondingly momentary increase of the current in the coil, and since the displacement of the coil in the magnetic field is due to the coil current, the coil and therewith the loud speaker membrane will not react momentarily to the voltage changes or oscillations of the input signal to the coil. The sound will be reproduced, therefore, with a certain distortion relatively to the electric input signal. When the electrically conducting cylinder is used this cylinder will be inductively coupled to the coil and act as a single winding, i.e. the cylinder will act as a short circuit winding in a transformer and thus reduce the self-induction of the coil and enable rapid current changes therein in response to corresponding voltage changes of the input signal. This means that the coil and the membrane may accelerate rapidly and oscillate in improved accordance with the input signal, whereby the sound distortion is reduced.

However, the coil extends axially to both sides of the air gap and oscillates between an inner position, in which the outer end of the coil is situated in the air gap, and an outer position, in which the inner end of the coil is situated in the air gap, and since the conducting cylinder is located inwardly from the air gap the improved acceleration capability of the coil will be more expressed in or adjacent the inner position of the coil than in or adjacent the outer position thereof, and for this reason the coil will generally oscillate slightly non-symmetrically about the middle plane of the air gap. The inductive coupling between the coil and the cylinder is low in the outer position of the coil, because only the inner end of the coil cooperates with the cylinder, and the improved response of the coil, therefore, is obtained only in coil positions adjacent the said inner position of the coil. The total sound distortion, therefore, is reduced, but certainly not eliminated.

It is the purpose of this invention to provide a loud speaker in which the voice coil will have a low inductance independently of its position relatively to the air gap, i.e. in which the coil may accelerate rapidly in the entire working range thereof so as to eliminate or considerably reduce the sound distortion.

According to the invention there is provided a loud speaker of the type referred to in which the cylindric element is extended so as to additionally project outwardly from the air gap to the other side thereof. In this loud speaker the voice coil will in all its positions be inductively coupled to the cylindric element along the entire length of the coil, i.e. the inductance of the coil will be small in all positions, and consequently the coil current can change rapidly also when the coil assumes an outer position. Thus, the coil may oscillate symmetrically about the middle of the air gap and accelerate rapidly from all positions whereby the sound distortion will be kept at a minimum.

In a loud speaker of the usual basic construction the invention can be realized in an extremely simple manner, since the additional cylindric element can be provided as a direct prolongation of the cylinder surrounding the rod magnet.

Figure 1:
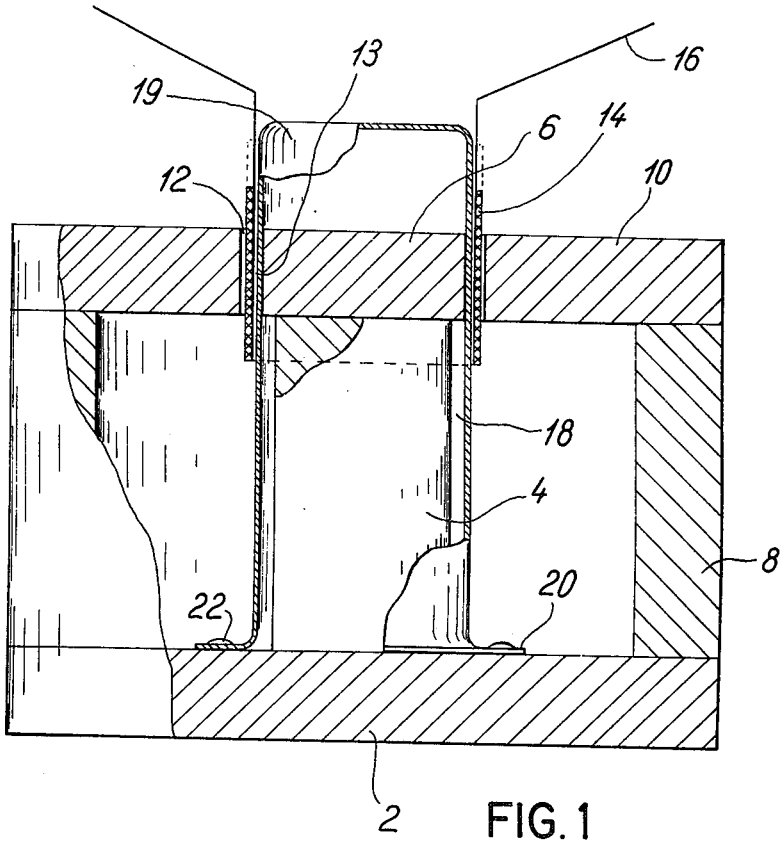

By way of example the invention is described in more detail in the following with reference to the accompanying drawing wherein FIG. 1 is a sectional view of a loud speaker according to an embodiment the invention and FIG. 2 is a sectional view of a loud speaker according to another embodiment of the invention.

The loud speaker as shown in FIG. 1 comprises in the usual manner a magnetic circuit including a circular base disc 2 at the middle of which there is placed a projecting rod magnet 4, the outer end of which carries a disc shaped pole piece 6. An exterior iron ring member 8 is placed on the base disc 2 so as to extend coaxially with the rod magnet 4 and having the same axial extension. The outer end of the ring member 8 carries an annular disc 10 having a central circular hole 12, the edge of which is situated concentrically with the periphery of the pole disc 6 slightly spaced therefrom, so that between these parts there is defined an annular air gap 13. In this gap is positioned a cylindric voice coil 14 connected with a loud speaker membrane 16. In a conventional manner which need no further illustration the membrane is reciprocally suspended in a loud speaker chassis so as to center the coil in the air gap.

Optimally the coil should project the same distance to both sides of the air gap.

Due to the concentrated radial magnetic field in the air gap the coil will oscillate when it is passed by an alternating current, whereby a sound frequent voltage fed to the coil will cause the coil and therewith the membrane 16 to oscillate for reproduction of the sound signal.

Inside the coil 14 there is mounted a stationary circular cylindric tube 18 surrounding the rod magnet 4 and its associated pole disc 6 and consisting of an electrically conducting material of small thickness, preferably copper.

According to the invention this tube extends beyond the pole disc 6, the outer portion thereof being designated 19. The axial extension of the outer portion 19 is sufficient to ensure that the coil 14 even in its outermost position shown in dotted lines remains entirely within the outer end of the tube portion 19. Thus, in any position of the coil there will be a full inductive coupling between the coil and the tube 18, and as mentioned the tube 18 acts as an inductive short circuiting of the coil, whereby the resulting inductance of the coil becomes low and independent of the position of the coil. The coil current, therefore, will always vary in rapid response to the variations of the voltage of the input signal, and consequently the sound distortion is kept at a minimum. The improved reproduction quality is audible, but can also be demonstrated by registering the sound pressure in front of the loud speaker when a so-called square wave signal is fed to the coil; a high quality loud speaker according to the invention reproduces the square wave signal with a low degree of distortion of the curve shape of the signal, this not being obtainable with conventional loud speakers.

Preferably the tube 18 is made as a drawn bowl member having a collar 20 enabling it to be secured to the base disc 2 in a simple manner, e.g. by means of rivets or screws, one of which is labeled 22 in the figure.

A secondary effect of the extended cylinder or tube 18 is that to an increased degree it reduces the modulation of the magnetic field in the air gap caused by the coil current and thereby reduces the so-called second harmonics distortion.

The invention is not limited to the embodiment shown, e.g. since for the electric effect of the tube 18 it is not imperative that the tube 18 be mounted inside the coil 14; it may as well be placed adjacent the edge of the hole 12 in the annular pole disc 10 so as to surround the voice coil 14 as shown in FIG. 2. In loud speakers in which the central elements 4 and 6 need not be encapsulated in a cylindric element and have electrically conducting surface portions it may be sufficient to add to these elements the outer portion 19 of the electrically conducting cylinder element, whether solid or hollow.

What is claimed is:

1. A loud speaker of the oscillating coil type including a voice coil associated with a loud speaker membrane and a magnetic circuit having an annular air gap in which the coil is located in such a manner that in its neutral, non-energized condition the coil projects axially from the air gap substantially uniformly to both sides thereof so as to be able to oscillate substantially symmetrically about the middle plane of the air gap, the magnetic circuit including a central member delimiting the inner side of the air gap and disposed in a region extending within the outer end of the voice coil, a cylindric element made of a non-magnetic material of good electrical conductivity being rigidly associated with the magnetic circuit concentrically with the coil and extending into the air gap from one side thereof, characerized in that said cylindric element is extended so as to additionally project outwardly from the air gap to the other side thereof beyond the forward end of the voice coil and the forward end of the central member thereby enabling substantially symmetrical oscillation of the voice coil about the middle plane of the air gap and reduction of sound distortion.

2. A loud speaker of the oscillating coil type including a voice coil associated with a loud speaker membrane and a magnetic circuit having an annular air gap in which the coil is located in such a manner that in its neutral, non-energized condition the coil projects axially from the air gap substantially uniformly to both sides thereof so as to be able to oscillate substantially symmetrically about the middle plane of the air gap, a cylindric element made of a non-magnetic material of good electrical conductivity being rigidly associated with the magnetic circuit concentrically with the coil and extending into the air gap from one side thereof, characterized in that said cylindric element is extended so as to additionally project outwardly from the air gap to the other side thereof, and in that the cylindric element is mounted inside the voice coil around a central rod shaped portion of the magnetic circuit, this rod portion projecting from a base disc which along its periphery is connected with one end of a ring member, the other end of which is connected with an outer edge portion of an annular disc member, the central opening of which is situated radially concentrically spaced from the outer end portion of said central rod portion so as to define the said air gap therebetween, characterized in that the cylindric element is at one end secured to the said base disc and therefrom projects outwardly around the central rod portion so as to have its outer end portion situated spaced outside the outer end of the central rod portion.

3. A loud speaker acccording to claim 2, wherein said cylindric element is shaped as a tube.

4. A loud speaker according to claim 2, wherein said cylindric element is shaped as a bowl member.

5. A loud speaker according to claim 1, wherein said material is copper.

6. A loud speaker according to claim 2, wherein said material is copper.

7. A loud speaker according to claim 1, wherein said cylindric element is mounted outside said voice coil.

* * * * *